US005391052A

United States Patent [19]

Correia et al.

[11] Patent Number: 5,391,052

[45] Date of Patent: Feb. 21, 1995

[54] IMPINGEMENT COOLING AND COOLING MEDIUM RETRIEVAL SYSTEM FOR TURBINE SHROUDS AND METHODS OF OPERATION

[75] Inventors: Victor H. Correia, Scotia; Theresa A. Brown, Ballston Lake; R. Paul Chiu, Scotia, all of N.Y.

[73] Assignee: General Electric Co., Schenectady, N.Y.

[21] Appl. No.: 152,363

[22] Filed: Nov. 16, 1993

[51] Int. Cl.[6] ..... F01D 25/12

[52] U.S. Cl. ..... 415/115; 415/116

[58] Field of Search ..... 415/115, 116; 416/97 R

[56] References Cited

U.S. PATENT DOCUMENTS

| | | | |
|---|---|---|---|
| 4,379,677 | 4/1983 | Hallinger et al. | 415/116 X |
| 4,826,397 | 5/1989 | Shook et al. | 415/116 |
| 5,100,291 | 3/1992 | Glover | 415/116 |
| 5,116,199 | 5/1992 | Ciokajlo | 415/116 X |
| 5,205,115 | 4/1993 | Plemmons et al. | 415/115 |
| 5,219,268 | 6/1993 | Johnson | 415/115 |

*Primary Examiner*—Edward K. Look
*Assistant Examiner*—Michael S. Lee
*Attorney, Agent, or Firm*—Nixon & Vanderhye

[57] ABSTRACT

The steam impingement cooling and retrieval system for turbine shrouds includes a plurality of circumferentially spaced housings about a turbine shroud, each housing being divided by an impingement plate defining first and second chambers on opposite sides of the housing. Steam supplied into a first chamber passes through a plurality of apertures formed in the impingement plate into the second chamber for impingement cooling of the shroud surface forming the opposite wall of the housing. Post-impingement steam passes from the compartment into a manifold for flow through and exhaust passage. In one form, a plurality of compartments are formed in the impingement plate. A first set of the plurality of compartments include through apertures for delivering steam from the first chamber into the second chamber. The second set of compartments communicates only with the second chamber and an exhaust passage whereby post-impingement steam passes from the second chamber through apertures of the impingement plate into the second set of compartments for flow to a manifold at the end wall of the housing for delivery to the exhaust passage.

14 Claims, 4 Drawing Sheets

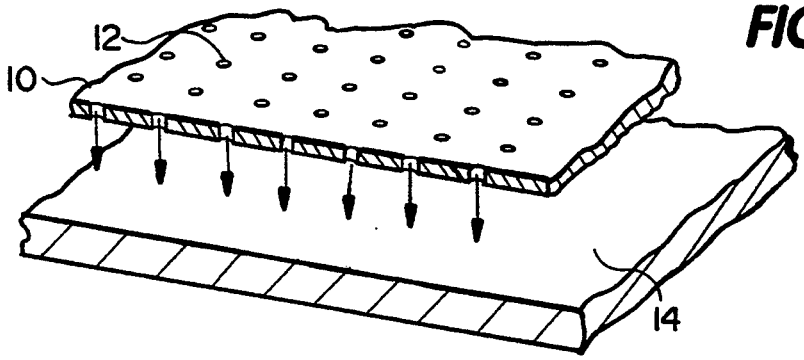
FIG. 1
(PRIOR ART)
FIG. 2
(PRIOR ART)
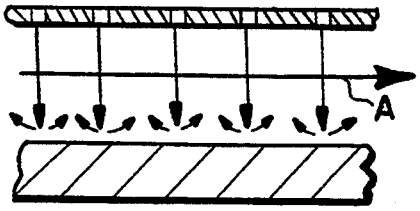
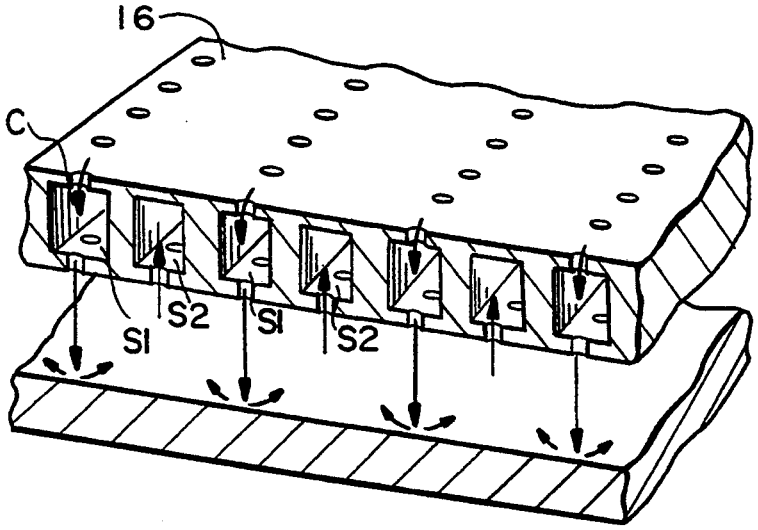
FIG. 3

IMPINGEMENT COOLING AND COOLING MEDIUM RETRIEVAL SYSTEM FOR TURBINE SHROUDS AND METHODS OF OPERATION

BACKGROUND AND SUMMARY OF THE INVENTION

The present invention relates to apparatus and methods for impingement cooling of turbine components and particularly relates to apparatus and methods for steam cooling turbine shrouds and retrieval of post-impingement cooling steam.

Current methods for cooling turbine shrouds employ an air impingement plate which has a multiplicity of holes for flowing air through the impingement plate at relatively high velocity due to a pressure difference across the plate. The high velocity flow through the holes, strikes and impinges on the component to be cooled. After striking and cooling the component, the post-impingement air finds its way to the lowest pressure sink leakage. However, as this spent cooling air travels to the leakage sink, the accumulating spent air crosses the paths of other high velocity jets of air which are directed to impinge on the component to be cooled. This cross flow of the spent air interacts with the high velocity incoming impingement cooling air to significantly degrade the effectiveness of the impingement cooling air as it crosses from the impingement plate to the component to be cooled.

To applicants' knowledge, an impingement cooling system using steam as the cooling medium for turbine shrouds has not heretofore been developed. Existing air impingement cooling apparatus and methods cannot be used for cooling with steam because post-impingement steam would leak into the turbine flow path. This would be unacceptable from a turbine-efficiency standpoint. A steam impingement cooling system for the turbine shroud must therefore be a closed system with only relatively insignificant leakage of steam.

In accordance with the present invention, there is provided apparatus and methods for impingement cooling of turbine components, particularly, a turbine shroud, using steam as the cooling medium. Specifically, an impingement plate having a plurality of flow passages or apertures through the plate is situated within a homing. The impingement plate defines with opposite walls of the housings a pair of chambers on opposite sides of the plate. Edges of the impingement plate are disposed in slots formed in the side walls and an end wall of the housing, the plate being inserted through a through-slot in the opposite end wall. Once the slot is inserted into the housing to define the chambers, the plate end extending through the through-slot opening in the end wall is welded shut to preclude leakage of steam from the housing as well as to maintain the impingement plate within the housing. The plate is not otherwise welded or braised to the shroud, but is seated in the slots about the housing.

As a consequence of this construction, the chambers on opposite sides of the impingement plate define cooling medium receiving and exhaust chambers. Thus, as the steam enters the system through an inlet pipe welded to a top wall of the housing, the steam supplied the first chamber finds the only available path for further flow is through the holes in the impingement plate. Accordingly, the steam passes through the holes at a substantial increase in velocity and is thereby directed for flow into the second chamber at high velocity and impingement against the shroud surface comprising the opposite or second wall of the housing. By impinging against the shroud surface, the surface is cooled.

In accordance with the present invention, low pressure pockets are provided in the walls of the homing axially along each circumferential wall of the housing. Radially outwardly, there is provided a manifold along the opposite walls of the housing, a plurality of passages communicating between the manifold and an exhaust passage carried by the wall of the housing.

Preferably, the containment wall on the supply side of the housing is pyramidal in shape with the highest area in the center where steam inlet and exhaust pipes are secured. This geometry provides for mixing of the steam in the plenum (corresponding to the first chamber) prior to impingement and ensures uniform distribution of steam to all of the impingement holes through the impingement plate. The passages between the manifold and the common exhaust passage may be cast in the first wall of the housing. The passages from the manifold along opposite side walls of the housing are wide and narrow and follow the length of the manifold. With the pyramidal shape of the housing wall, the passage narrows towards the exhaust passage.

In another form of the present invention, the impingement plate per se includes a plurality of longitudinally extending compartments. A first set of the plurality of compartments comprises cooling medium supply compartments having apertures or openings passing through upper and lower surfaces of the compartment for flowing cooling steam from the first chamber through the apertures into the compartments and through the lower apertures into the second chamber for impingement cooling of the shroud surface. The second set of compartments has a plurality of apertures or openings in communication with the second chamber for receiving the post-impingement cooling steam and directing that spent steam to an exhaust manifold located at one end of the compartment. Preferably, the compartments extend longitudinally of the plate and alternate one with the other throughout their lengths whereby the cooling impingement steam directed against the shroud surface by the aperture of a compartment of a first set thereof is returned after cooling to one or more laterally adjacent compartments and eventually to the exhaust passage. In one form of this invention, a plurality of sleeves may be disposed on the return apertures, such that the sleeves open directly adjacent the shroud surface being cooled.

In a preferred embodiment according to the present invention, there is provided an impingement steam cooling apparatus for turbines comprising a turbine shroud having first and second walls spaced from one another and an impingement plate spaced between the walls to define on opposite sides of the impingement plate first and second chambers substantially sealed from one another, the impingement plate having a plurality of flow passages therethrough providing for communication of cooling steam between the chambers through the passages, a supply passage in communication with the first chamber for supplying cooling steam into the first chamber for flow through the passages and affording impingement cooling of the second wall and an exhaust passage in communication with the second chamber for exhausting post-impingement cooling steam from the second chamber.

In a further preferred embodiment according to the present invention, there is provided a method of cooling a turbine shroud by steam impingement on the shroud comprising the steps of flowing cooling steam into a first chamber within a substantially sealed housing, flowing cooling steam from the first chamber through a plurality of apertures disposed in an impingement plate dividing the housing into the first chamber and a second chamber on the side of the impingement plate opposite the first chamber and directing the steam flowing through the apertures for passage across the second chamber for impingement against the shroud to cool the shroud, and flowing post-impingement cooling steam in the second chamber to an exhaust passage.

Accordingly, it is a primary object of the present invention to provide novel and improved apparatus and methods for steam impingement cooling of turbine shrouds and retrieval of the post-impingement cooling steam.

BRIEF DESCRIPTION OF THE DRAWINGS

FIG. 1 is a fragmentary perspective view of an air impingement cooling system, known in the prior art;

FIG. 2 is a fragmentary cross-sectional view of the air impingement cooling system of the prior art illustrated in FIG. 1;

FIG. 3 is a fragmentary perspective view of a steam impingement cooling system for a turbine component according to the present invention;

DETAILED DESCRIPTION OF THE DRAWINGS

Figure 4:
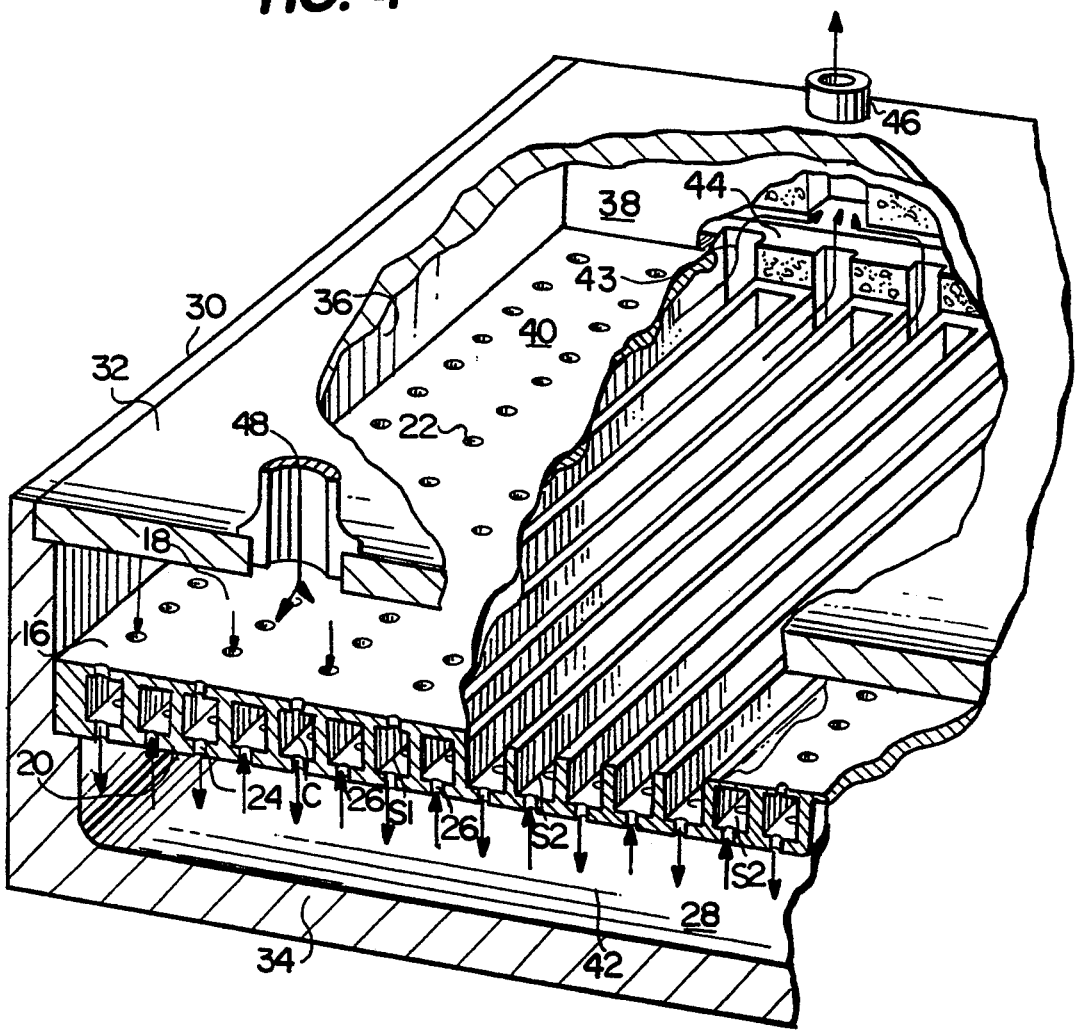
FIG. 4 is a fragmentary perspective view with parts broken out and, in cross-section, illustrating the housing for the steam cooling system illustrated in FIG. 3.

Referring now to the drawing figures, particularly to FIGS. 1 and 2, there is illustrated an air impingement system for cooling a surface according to the prior art. In that system, there is provided an impingement plate 10 having a plurality of apertures 12 through plate 10 for flowing cooling air onto a surface 14 to be cooled. The air flows as a result of a pressure differential across the impingement plate 10.

In FIG. 2, it will be seen that the post-impingement air flows laterally and longitudinally immediately after impingement and eventually flows to a leakage sink to one side of the chamber as illustrated by the arrow designated "A." Thus, the post-impingement air crosses the paths of the pre-impingement cooling air and hence interferes with and degrades the efficiency of the pre-impingement air prior to its contact with the cooling surface. These cross-flows thus are to be avoided in any type of cooling system. Also, in the prior air impingement cooling systems, there was no need to seal the system, because air leakage into the flow paths of the turbine would not deleteriously affect the performance of the turbine. However, such air impingement systems cannot be used with a steam impingement cooling system because the post-impingement steam would leak into the flow path, which would be unacceptable from an efficiency standpoint.

Referring now to FIGS. 3 and 4 hereof, there is illustrated a closed cooling impingement and retrieval system for steam cooling of a turbine component, e.g., a turbine shroud. More particularly, the cooling system includes an impingement plate 16 having a plurality of compartments generally designated "C." As illustrated in FIG. 4, the cooling compartments C extend generally longitudinally through the impingement plate 16 and in side-by-side relation to one another. The cooling plate thus includes upper and lower wall surfaces 18 and 20, respectively, in part defining the compartments C. A plurality of apertures or cooling flow passages 22 are disposed through the upper wall surface 18 in alignment with a first set S1 of the plurality of compartments C. Additionally, cooling flow apertures or passages 24 open through the lower surface 20 of the compartments of the first set, whereby a cooling medium may flow through passages 22 into the compartments C of the first set S1 thereof and outwardly of the impingement plate 16 through passages 24. The lower wall also includes apertures 26 in communication with a second set S2 of cooling medium exhaust compartments C and a chamber 42 below the impingement plate 16. In a preferred embodiment of the present invention, the first and second sets of cooling medium supply and exhaust compartments S1 and S2, respectively, alternate across the impingement plate 16.

Referring again to FIG. 4, cooling plate 16 is situate in a housing 30 around and forming part of a shroud of a turbine. The homing includes an upper wall 32 and a lower wall 34, the latter wall forming a surface of the shroud to be cooled. The housing 30 is one of a plurality of housings disposed about the turbine shroud and includes side and end walls 36 and 38, respectively. Impingement plate 16 is disposed in the housing in close-fitting substantially sealing engagement with the side and end walls and defines with the upper and lower walls 32 and 34, respectively, first and second chambers 40 and 42 on opposite sides of impingement plate 16. As illustrated in FIG. 4, the opposite ends of the cooling medium supply compartments of the first set thereof are closed, such that, given a pressure difference across the impingement plate 16, the cooling medium will flow from the first chamber 40 through the apertures 22 into the compartments S1 and out the lower apertures 24 into the second chamber 42. However, became the exhaust compartments of the second set of compartments S1 are closed along the upper surface 18 of the impingement plate 16, the post-impingement cooling flow received through apertures 26 into compartments S2 exits through passages 43 at one end of the compartments in communication with a manifold 44. The manifold 44 is, in turn, in communication with an exhaust passage 46 for returning the steam to the source. The housing may be formed of a casting with the end wall passages receiving the steam from the second set of compartments and the manifold 44 integrally formed in the casting. The upper wall 32 of the housing 30 also includes a steam supply passage 48 for supplying cooling steam from a suitable source into the first chamber 40.

In operation, cooling steam is supplied through passage 48 into first chamber 40. Became the chamber is essentially sealed, the cooling steam must pass through apertures 22, the first set of compartments S1, through the apertures 24 and into the second chamber 42. Became of the high pressure of the steam inlet to the first chamber 40, the steam exits the passages 24 at high velocity for direct impingement on the lower wall surface 34 to be cooled. The post-impingement steam or spent cooling steam, rather than flowing laterally forming cross-flows interfering with the pre-impingement cooling steam, flows back toward the impingement plate and exits through the apertures 26 into the second set of compartments S2. The steam flows longitudinally along the second set of compartments into the passages 43 and manifold 44 for exit through passage 46.

Figure 5:
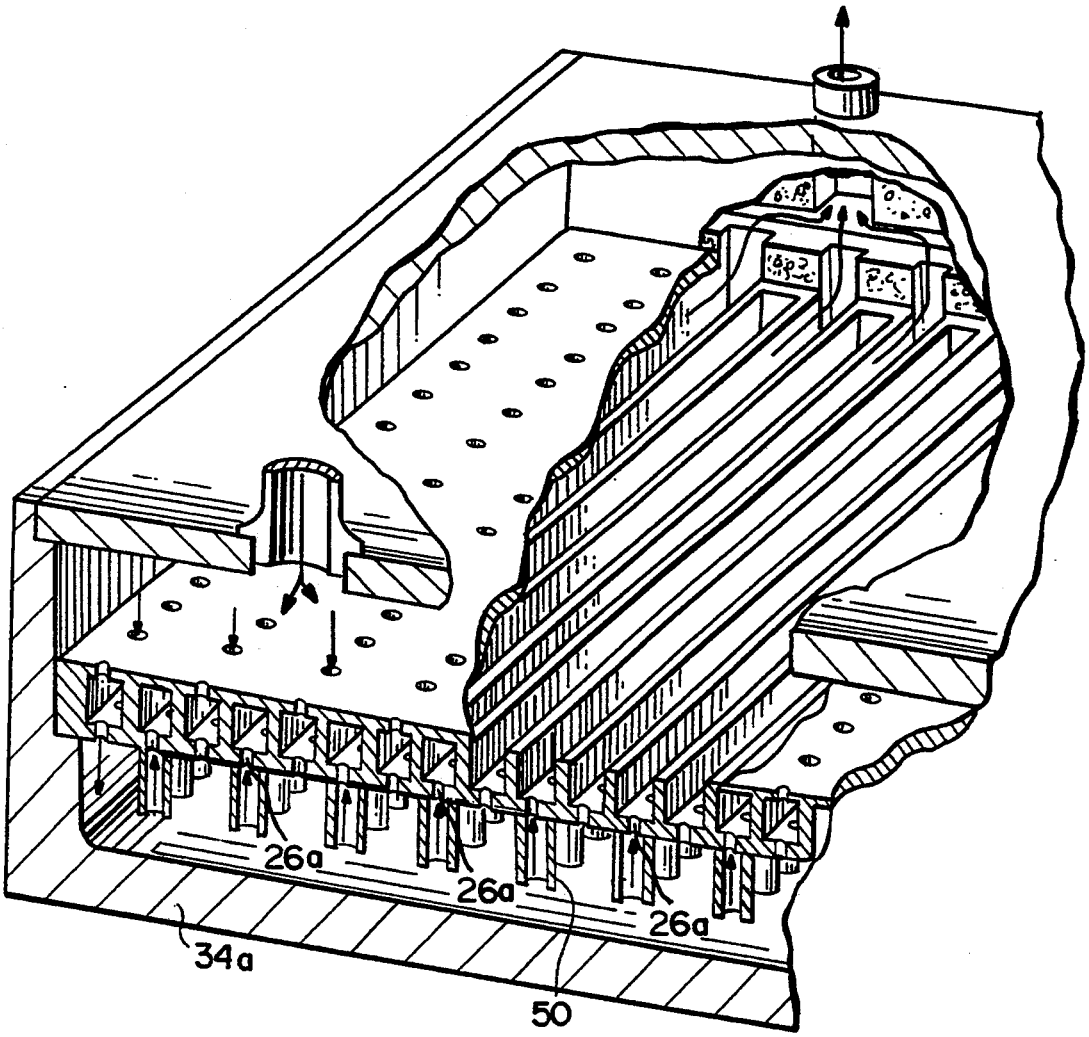
FIG. 5 is a view similar to FIG. 4 illustrating a further embodiment hereof.

Referring to the embodiment hereof illustrated in FIG. 5, like reference numerals are applied to like parts, followed by the suffix "a." In this form, the apertures 26*a* which receive the post-impingement cooling steam for flow in the second set of compartments S2, are provided with a surrounding depending sleeve 50, the open end of which terminates closely adjacent the surface 34*a* being cooled. In this manner, the effects of the exhaust openings 24*a* on the adjacent impingement jets is reduced, and the exhaust or spent steam is picked up from the cooled surface at an earlier stage.

Figure 6:
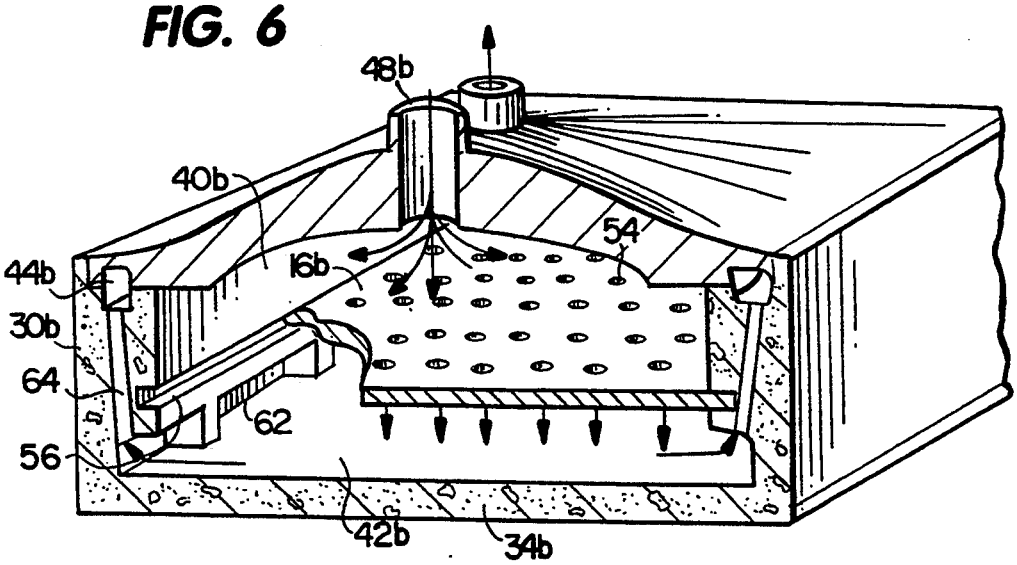
FIG. 6 is a perspective view with parts in cross-section illustrating a further embodiment of a steam impingement cooling system according to the present invention showing the steam supply.
Figure 7:
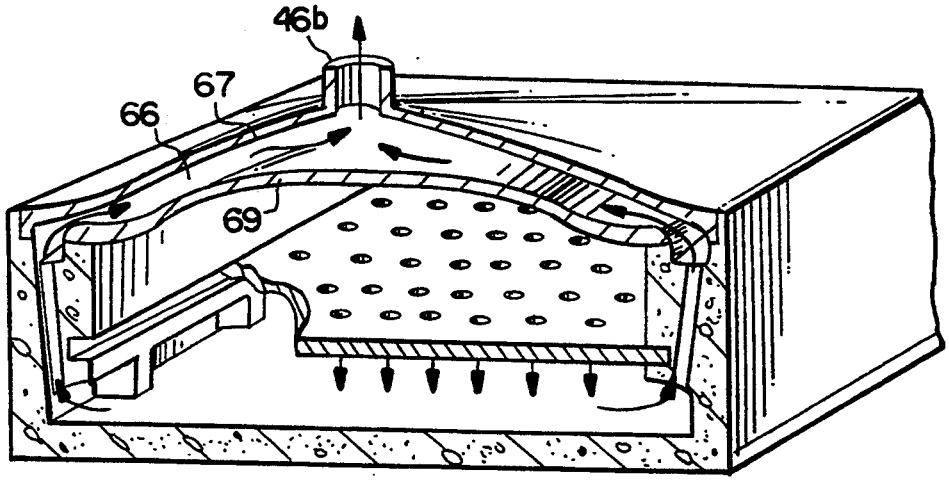
FIG. 7 is a view similar to FIG. 6 illustrating the steam return for the system of FIG. 6.

Referring now to FIGS. 6 and 7, thee is illustrated a simplified version of the steam cooling apparatus according to the present invention. In this form, like reference numerals are applied to like parts as in the previous embodiments, followed by the letter suffix "b." The impingement plate 16*b* includes through apertures 54 communicating between the upper and lower compartments 40*b* and 42*b*. The impingement plate 16*b* is preferably disposed in slots 56 formed along the interior wall surfaces of the side walls and an end wall of the housing. The opposite end wall has a through-slot through which the impingement plate 16*b* can be slidably received within the housing 30*b*. The impingement plate 16*b* is welded along the outside of the housing to retain it within the housing with its opposite side and edges forming substantial seals in the side wall and end wall slots. A plurality of exhaust ports 62 are disposed along the side walls in communication with the second chamber 42*b*. The ports 62 lie in communication through suitable passages 64 in the side walls with a manifold 44*b*. The manifold, in turn, is connected to the exhaust passage 46*b* by a passageway 66 formed in the upper wall of the housing and defined between upper and lower partitions 67 and 69, respectively. The passageway 66 may be connected to the manifold 44*b* substantially along the entire length of the housing and narrows to direct the steam toward the exhaust passage 46*b* while the passage enlarges in the downstream direction to prevent any build up of pressure.

In this embodiment, cooling steam is provided through the inlet 48*b* into the first chamber 40*b*. Because the chamber is substantially sealed, the steam flows through the apertures 54 at high velocity into the second chamber 42*b*. The apertures 54 direct the high velocity flow of steam for impingement cooling of the shroud surface 34*b*. The post-impingement steam flows through the ports 62 and passages 64 into the manifold 44*b* for flow through the passageways 66 to the exhaust passage 46*b*. While there is some crossflow involved in this embodiment, became the ports 62 extend the full length of the housing and along opposite sides, the crossflow is minimized.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Impingement steam cooling apparatus for turbines comprising:

a turbine shroud having first and second walls spaced from one another and an impingement plate spaced between said walls to define on opposite sides of said impingement plate first and second chambers substantially sealed from one another, said impingement plate having a plurality of flow passages therethrough providing for communication of cooling steam between said chambers through said passages;

a supply passage in communication with said first chamber for supplying cooling steam into said first chamber for flow through said passages and affording impingement cooling of said second wall; and an exhaust passage in communication with said second chamber for exhausting post-impingement cooling steam from said second chamber;

said compartment including side and end walls defining with said impingement plate and said first and second walls, said first and second chambers, respectively, said plurality of exhaust ports being spaced along each of said side walls, said manifold lying in communication with said ports and located on a side of said impingement plate remote from said second chamber.

2. Apparatus according to claim 1 wherein said first wall includes a pair of spaced partitions defining said exhaust manifold, said exhaust passage opening through one of said partitions for communication with said exhaust manifold.

3. Impingement steam cooling apparatus for turbines comprising:

a turbine shroud having first and second walls spaced from one another and an impingement plate spaced between said walls to define on opposite sides of said impingement plate first and second chambers substantially sealed from one another, said impingement plate having a plurality of flow passages therethrough providing for communication of cooling steam between said chambers through said passages;

a supply passage in communication with said first chamber for supplying cooling steam into said first chamber for flow through said passages and affording impingement cooling of said second wall; and an exhaust passage in communication with said second chamber for exhausting post-impingement cooling steam from said second chamber;

said impingement plate including a plurality of discrete compartments, a first plurality of said compartments comprising a first set thereof with each compartment having a flow passage in communication with said first chamber for flowing cooling steam into said first set of compartments and a flow passage for flowing cooling steam from said first set of compartments into said second chamber, a second plurality of said compartments comprising a second set thereof, each compartment of said second set thereof having a flow passage in communication with said second chamber for receiving post-impingement cooling steam therein and a flow passage in communication with said exhaust passage for flowing the post-impingement cooling steam into said exhaust passage.

4. Apparatus according to claim 3 including a plurality of flow passages in communication between said first chamber and each compartment of said first set thereof and a plurality of flow passages in communication between said second chambers and each compartment of said second set thereof.

5. Apparatus according to claim 4 including an exhaust manifold in communication with each compartment of said second set of compartments and with said exhaust passage.

6. Apparatus according to claim 4 wherein said first and second sets of compartments comprise rows of compartments extending generally parallel to one another.

7. Apparatus according to claim 6 wherein said rows of compartments of said first and second sets thereof alternate with one another across said impingement plate.

8. Impingement steam cooling apparatus for turbines comprising:

a turbine shroud having first and second walls spaced from one another and an impingement plate spaced between said walls to define on opposite sides of said impingement plate first and second chambers substantially sealed from one another, said impingement plate having a plurality of flow passages therethrough providing for communication of cooling steam between said chambers through said passages;

a supply passage in communication with said first chamber for supplying cooling steam into said first chamber for flow through said passages and affording impingement cooling of said second wall;

an exhaust passage in communication with said second chamber for exhausting post-impingement cooling steam from said second chamber; and a plurality of sleeves projecting from said impingement plate and terminating adjacent said second wall for receiving post-impingement cooling steam subsequent to impingement on said second wall and directing the post-impingement cooling steam from the second chamber into said second compartments.

9. A method of cooling a turbine shroud by steam impingement on the shroud comprising the steps of:

flowing cooling steam into a first chamber within a substantially sealed housing;

flowing cooling steam from said first chamber through a plurality of apertures disposed in an impingement plate dividing the housing into said first chamber and a second chamber on the side of the impingement plate opposite said first chamber and directing the steam flowing through said apertures for passage across said second chamber for impingement against the shroud to cool the shroud; and flowing the cooling steam from said first chamber into and through a first set of compartments formed in said impingement plate for flow into said second chamber and direct impingement on said cooling surface, and flowing post-impingement cooling steam in said second chamber into a second set of compartments formed in said impingement plate for flow to said exhaust passage.

10. A method according to claim 9 including alternating said first and second sets of compartments in said impingement plate.

11. Impingement cooling apparatus for a turbine comprising:

a turbine shroud having first and second walls spaced from one another and an impingement plate spaced between said walls to define on opposite sides of said impingement plate first and second chambers substantially sealed from one another, said impingement plate having a first set of a plurality of flow passages therethrough providing for communication of a cooling medium between said chambers through said passages, said flow passages being spaced from one another;

a supply passage in communication with said first chamber for supplying the cooling medium to said first chamber for flow through said first set of passages and across said second chamber for impact against and impingement cooling of said second wall;

said impingement plate carrying a second set of a plurality of flow passages with the flow passages of said second set being interspersed between and among the flow passages of said first set thereof to enable post-impingement flow of the cooling medium to be extracted from adjacent the locations of impact of the cooling medium against said second wall thereby substantially avoiding cross-flow effects of post-impingement cooling medium on the cooling medium flowing across said second chamber toward said second wall.

12. Apparatus according to claim 11 wherein said first and second sets of flow passages are arranged in alternating rows of passages.

13. Apparatus according to claim 12 wherein each row of at least a plurality of the flow passages of the first set thereof is flanked on opposite sides by rows of the flow passages of said second set thereof.

14. A method of cooling a turbine shroud by steam impingement on the shroud comprising the steps of:

flowing cooling steam into a first chamber within a substantially sealed housing;

providing an impingement plate having a first set of a plurality of flow passages therethrough for flowing cooling steam from said first chamber into a second chamber and a second set of a plurality of flow passages interspersed between and among the flow passages of said first set thereof for flowing post-impingement cooling steam from the second chamber;

flowing cooling steam from said first chamber through said first set of a plurality of flow passages and across said second chamber for impingement steam cooling of a shroud wall opposite said impingement plate; and flowing post-impingement cooling steam in said second chamber through the flow passages of said second set of flow passages to enable the post-impingement flow of cooling steam to be extracted from adjacent the location of impact of the cooling steam against said shroud wall, thereby substantially avoiding cross-flow effects of the post-impingement cooling steam on the cooling steam flowing across said second chamber toward said shroud wall.

* * * * *